US006022503A

United States Patent [19]

Hudkins et al.

[11] Patent Number: 6,022,503

[45] Date of Patent: Feb. 8, 2000

[54] METHOD OF MAKING FLOOR MATS

[75] Inventors: Patrick E. Hudkins, Carlisle; Mark W. Thompson, East Berlin; Steven P. Hammond, Shippensburg, all of Pa.

[73] Assignee: Lear Corporation, Southfield, Mich.

[21] Appl. No.: 08/925,596

[22] Filed: Sep. 8, 1997

[51] Int. Cl.[7] ..... B29D 31/00

[52] U.S. Cl. ..... 264/243; 264/257; 264/319; 264/322; 264/324; 264/DIG. 65; 156/312

[58] Field of Search ..... 264/243, 324, 264/322, 319, 257, DIG. 65; 156/222, 312

[56] References Cited

U.S. PATENT DOCUMENTS

| | | | |
|---|---|---|---|
| 4,016,318 | 4/1977 | DiGioia | 428/95 |
| 4,174,991 | 11/1979 | Reuben | 156/242 |
| 4,332,767 | 6/1982 | Kitanaka et al. | 264/322 |
| 5,154,961 | 10/1992 | Reuben | 428/82 |
| 5,207,963 | 5/1993 | Grace | 264/163 |

OTHER PUBLICATIONS

H. Potente, J. Natrop, "Quality Assurance of Computer Controlled Hot–Tool Welding for Mass Production", Journal of Polymer Engineering and Science, Mid–Apr. 1991, vol. 31, No. 7, p. 519–525.

*Primary Examiner*—Jan H Silbaugh
*Assistant Examiner*—Stefan Staicovici
*Attorney, Agent, or Firm*—Synnestvedt & Lechner LLP

[57] ABSTRACT

Methods of making thermoplastic articles having integral projections extending from a surface thereof. The methods utilize a mold plate having a top side, an underside and a cavity extending from the top side to the underside for forming the integral projection. The methods utilize an air escape passage for allowing escape of air from the cavity in the mold plate during the pressing operation. At least a portion of the molding operation is conducted while the temperature of the entrance to the air escape passage is below the molding temperature of the thermoplastic material being molded.

18 Claims, 2 Drawing Sheets

METHOD OF MAKING FLOOR MATS

FIELD OF THE INVENTION

The present invention relates generally to processes for the production of thermoplastic articles, and more particularly to fiber-faced thermoplastic articles such as flooring mats. The methods of the present invention are particularly well suited to the forming of floor mats having a plurality of projections, or nibs, extending from the underside thereof to enhance stability of the mat when placed on a carpeted surface such as, for example, the carpeted floor of an automobile.

BACKGROUND OF THE INVENTION

Fiber-faced articles, such as flooring carpets and mats, are in common use in homes, businesses and transportation vehicles such as automobiles, buses, trains, aircraft and marine craft. Such articles provide a pleasing appearance as well as comfort, warmth, and improved acoustic characteristics. It is quite common, however, for certain areas of carpet, as installed, to receive substantially more foot traffic, and thus, wear and tear, as compared with other areas. For instance, in automobiles there is frequently a greater degree of wear in the foot well of the driver's position as compared with other areas within the passenger compartment.

In order to accommodate such uneven wear in automobile carpeting, fiber-faced articles known as "throw-in mats" are frequently used to protect the high traffic areas from wear. A common problem in the use of such throw-in mats is the tendency of the floor mat to slip on the permanent carpet when such mats are constructed with a relatively smooth backing. To overcome this problem, such mats have been developed with a backing having a plurality of downward extending projections, known as nibs, which extend into and become anchored in the underlying carpet, thereby minimizing undesired lateral movement. Because the effectiveness of the nibs requires an underlying surface into which the nibs can become anchored, it is not desirable to have nibs located on those portions of a floor mat which will be placed above a hard surface such as, for example, the non-carpeted surface often found under the pedals in the driver's side floor well of an automobile. In order to overcome this problem, it is highly desirable that the process used to form such mats is capable of efficiently and economically tailoring the pattern of nibs on the floor mat to the large number of different foot well configurations found in the numerous automobiles now produced in the United States and throughout the world.

The downward projecting nibs are often formed from the main body of the backing material of the floor mat. It has been heretofore known to form mats with nibbed backings by continuous extrusion of thermoplastic material into the nip between two cooled rolls, wherein one of the rolls has small cavities therein for forming the nibs. In order to ensure the economic production of mats in this fashion, it is generally recognized that the economies of scale must be utilized, which means that such a process requires very large and expensive extrusion equipment and rolls. However, such a process is encumbered by poor flexibility in the formation of nib pattern and can not be readily adapted to the formation of mats with unusual shapes or to the formation of mats with a wide variety of nib patterns. Thus, such a process suffers from the severe disadvantage of not being practical for the formation of original equipment thrown-in mats.

A mat forming process which exhibits superior design flexibility involves the joining of preformed blanks of thermoplastic sheeting to corresponding blanks of preformed carpet. In such a process, which is generally batchwise or semi-continuous, each backing blank is joined to the carpet blank in a mold press operation of the type disclosed, for example, in U.S. Pat. No. 4,174,991—Reuben, which is incorporated herein by reference. In methods of this type, the backing/carpet combination is placed into a mold having nib cavities arranged in the desired pattern. The mold plate is typically placed on the lower platen of the press, which is heated to a relatively high temperature. The backing/carpet combination is exposed in the press to time, temperature and pressure conditions which cause the backing material to flow into and fill the nib-shaped cavities, thereby forming the nibbed portion of the mat.

In order to ensure that the backing material completely fills the cavities and thereby fully forms the desired nib, it is necessary to provide means for the air occupying the indentations to escape. This is commonly accomplished by the use of air vent channels leading out from the cavities to the edge of the mold plate. In this way, the air which occupies the nib-forming cavities in the mold plate is allowed to evacuate the cavities as the heated backing material flows in.

Applicants have recognized a problem with the use of such air vent channels in connection with previously developed methods of nib formation. More particularly, applicants have noted the tendency of such air vent channels to become blocked as the heated backing material flows not only into the cavity but also into the air vent channels themselves. Upon cooling, the material which has flowed into the air vent channels hardens and, when the floor mat is removed from the mold plate, certain nibs will bear undesirable extensions representing the additional material which has flowed into the air vent channels. Furthermore, and equally undesirable, many of the air vent channels become blocked by backing material which has cooled and remains in the channel upon removal of the mat. The resulting blockage defeats the function of the air vent channel, and additional time and labor are required to remove the backing material causing such blockage.

In view of the problems associated with the prior art, it is an object of the present invention to provide efficient and flexible methods of forming floor mats having a non-flat backing surfaces.

It is another object of the present invention to provide methods of forming floor mats comprising a fabric layer and a thermoplastic backing layer wherein the backing layer bears a plurality of integral projections.

SUMMARY OF THE INVENTION

The present invention is directed to methods of making thermoplastic articles having an integral projection extending from a surface thereof. The methods generally utilize a mold plate having a top side, an underside, a cavity extending from about said topside to about said underside for forming said integral projection. The methods also generally utilize an air escape passage for allowing escape of air from the cavity in the mold plate.

According to preferred operation of the invention, a blank of the thermoplastic material is compression molded into the cavity to form an integral projection in the finished article. An important aspect of the invention is conducting at least a portion of said molding operation while the temperature of the entrance to the air escape passage is below the molding temperature of the thermoplastic material. According to preferred embodiments, a top-to-bottom temperature gradient of at least about 50° F. is present in the mold plate during at least a portion of the molding step and preferably prior to the molding step being 50% complete. Applicants have found that the use of such methods provides important and significant advantages over prior processes, as explained in detail hereinafter.

The present invention is especially well adapted for use in connection with fabric faced throw-in mats, especially throw-in mats faced with tufted pile fabric.

DETAILED DESCRIPTION OF PREFERRED EMBODIMENTS

The present methods are particularly well adapted to the efficient and relatively rapid formation of fabric-faced floor mats of the type having a thermoplastic backing with nibs or projections extending therefrom. It will be appreciated by those skilled in the art, however, that the methods disclosed herein are adaptable for use generally in the formation of thermoplastic articles having an integrally formed projection extending therefrom.

The present methods generally require the provision of a preformed blank of thermoplastic material. As used herein, the term "blank" refers to a mass of material in a predefined size and shape. According to preferred embodiments, the thermoplastic blank is a relatively thin sheet or film of thermoplastic material. For embodiments involving the formation of floor mats, the preformed blank preferably comprises a sheet of thermoplastic having a thickness of from about 0.020 inches to about 0.150 inches, with a peripheral dimension that is predefined according to the contemplated use.

As those skilled in the art will readily understand from a reading of the present specification, any thermoplastic material which is formable by compression molding is acceptable for use in accordance with the present invention. It will be appreciated, therefore, that the term "thermoplastic" as used herein includes not only thermoplastic polymers but also compression moldable thermoplastic elastomers.

For embodiments involving the formation of fabric-faced floor mats, the thermoplastic material of the present invention is preferably a material with a hardness on the Shore A scale of about 50 to about 90, and even more preferably a Shore A hardness of about 65 to about 75. In certain of such embodiments, the thermoplastic material preferably comprises in major proportion, and even more preferably consists essentially of, thermoformable polyolefin.

The present methods also generally require the provision of a compression mold. Many such molds are known and available in the art, and it is contemplated that all such molds are adaptable for use in accordance with the present invention. In the preferred embodiments, the compression mold is in the form of relatively thin plate having a top side, an underside and a cavity in the topside for forming said integral projection.

Figure 1:
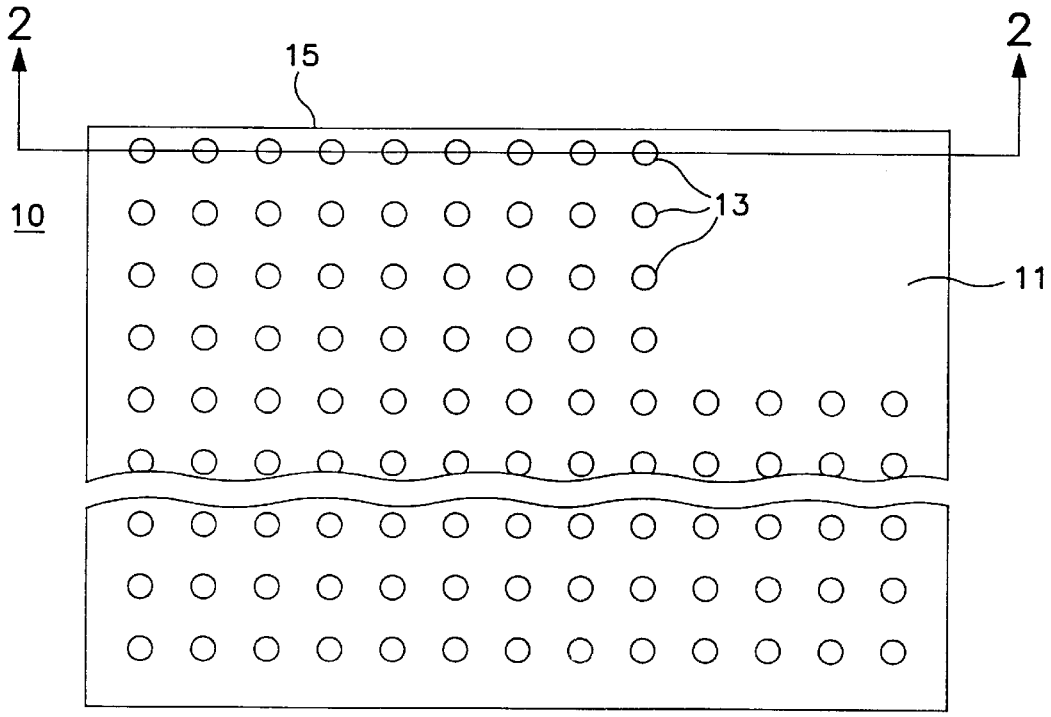
FIG. 1 is a plan view of a mold plate in accordance with one embodiment of the present invention.
Figure 2:
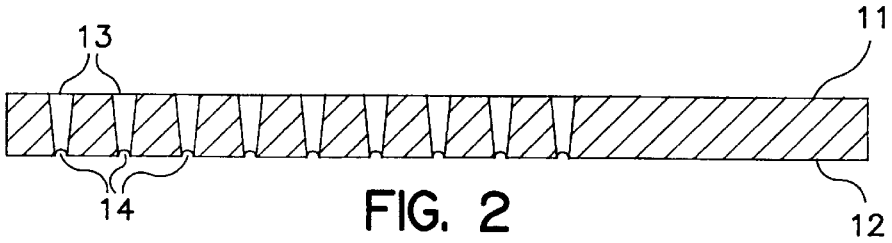
FIG. 2 is a cross-sectional view taken along line 2—2 of FIG. 1.

An illustrative embodiment of a mold plate in accordance with the present invention is shown in FIGS. 1 and 2. The mold plate, designated generally as 10, has a topside 11, an underside 12 and a plurality of cavities 13. For the purposes of the present disclosure, the topside of the mold plate refers to the side of the plate into which the thermoplastic material is molded, and the underside refers to the opposite side of the mold plate. It will be appreciated that the cavities can be provided in the shape and number required for the intended application, and all such shapes and numbers are within the scope of the present invention. In the illustrated embodiment, the mold plate 10 has cavities 13 which are frusto-conical in shape. Further, the cavities can be arranged in any desired pattern and/or density, depending on, among other things, the particular end use of the floor mat to be constructed. In the illustrated embodiments, the cavities are arranged in substantially regularly spaced rows.

An important aspect of preferred embodiments of the present invention is the use of a pressure relief means for allowing air or other fluids in the mold cavity to escape therefrom. Preferably such pressure relief means comprises a mold plate in which the projection-forming cavity has an air escape passage associated therewith. It will be appreciated, however, that other structures can be utilized to perform the pressure relief function. For example, in some embodiments it may be preferred to incorporate air escape passages in the platen which supports the mold plate during the molding operation.

As used herein, the term "air escape passage" refers to any means, such as a channel, passage or an interconnected series of channels or passages, which allows gas present in the cavity at the time molding begins to escape as the thermoplastic material flows therein. Preferably, the air escape passage is formed in the underside of the mold plate and is located at about the furthest extent of the cavity from the topside of the mold plate. As used herein, the furthest extent of the cavity is the portion of the cavity which is last exposed to the thermoplastic material during the molding step. In most embodiments, the furthest extent of the cavity is the portion of the cavity located the greatest distance from the opening in the topside of the mold plate. In this way, the entrance to the air escape passage is located so that it will have minimal interference with the full formation of the projection, that is, the air escape passage will not encounter thermoplastic material in the molding process until the projection has been substantially fully formed.

It is contemplated that the particular nature and type of the air escape passage used will vary depending upon numerous considerations. Applicants have discovered, however, that certain embodiments of the present invention produce superior results with the preferred air escape passages described herein. In the illustrated embodiment, the cavities 13 in mold plate 10 are frusto-conical cavities extending from the topside 11 to the underside 12, and the air escape passages are air vents which comprise open channels 14 formed in the surface of the underside of the mold plate. The channels 14 extend from the cavity to a peripheral edge 15 of the mold.

A preferred alternative to air channels 14 is the use of a large number of relatively small, interconnected and/or overlapping indentations, hollows, notches, dents, cavities, etc. (hereinafter referred to for convenience as "indentations") forming a passageway matrix. Such a matrix is preferably formed in the underside of the mold plate, but alternatively or supplementally may be formed in the surface of the platen which supports the mold plate. A preferred method for forming such a matrix is to use conventional fluid abrasive/impingement techniques, such as sand blasting, to create a large number of relatively small, interconnected/overlapping and substantially randomly distributed indentations in the appropriate surface. Applicants have discovered that such a structure provides several important benefits. For example, this structure permits the air escape passages to perform the desired pressure relief function while minimizing the depth of the indentations. Minimizing the depth of the indentations helps to ensure that the cavity is substantially filled with thermoplastic at the time it reaches the entrance to the air escape passages. Furthermore, while the interconnected/overlapped matrix configuration is sufficient to permit egress of the air, thermoplastic material encounters a relatively high degree resistance to flow into such a matrix configuration. As a result this preferred embodiment has been found to regularly produce very precisely formed, high quality nibs.

The mold plate of the present invention can be constructed from a variety of materials well known in the art. The considerations applicable to the selection of the mold plate materials include ease of tooling, heat conductivity, and durability under repeated application of heat and compressive force. Preferably, the mold plate will comprise a metal, and more preferably, an aluminum alloy. In certain preferred embodiments, the surface of the mold plate is subjected to a hardening treatment to improve the durability thereof. Mold plate dimensions will generally vary according to the configuration of the article to be produced therewith. In typical embodiments, the thickness of the mold plate corresponds to the length of the projection to be produced.

For floor mats to be used in automobiles, the pattern of nib-forming cavities is preferably compatible with the carpeted area of the foot well in which the floor mat will be installed. Given the variations in size and shape among the different foot wells within any given automobile, as well as across different years, makes and models of automobiles, it will be understood that processes which are capable of using mold plates of the type described herein are highly desirable from a cost and flexibility standpoint. That is, the fabrication of mold plates is relatively inexpensive, and it is therefore possible to readily produce a large variety and number of floor mat constructions according to the present invention.

As will be understood by those skilled in the art, compression molds are typically utilized by placing thermoplastic material on the topside of the mold plate and compressing the thermoplastic so that it flows into the cavity. Applicants have found that the thermal condition of the mold plate and/or of the platen on which it is supported during the molding step has an important impact on avoiding the disadvantages of the prior art and achieving the benefits of the present invention. More specifically, an important aspect of the present invention involves the step of processing the mold plate such that the temperature of the mold plate in the region of the air escape passage entrance to the cavity is below the molding temperature of the thermoplastic material. For the purposes of convenience in connection with the present description, such a mold plate is sometimes referred to herein as a temperature controlled mold plate. Applicants have found that controlling the temperature of the mold plate in this fashion ensures that there will be no deleterious flow of thermoplastic material into the air escape passage during the molding process.

According to preferred embodiments of the type described above, the region proximate to furthest extent of the cavity is substantially coincident with region of the air escape passage entrance, and accordingly the temperature in the region of the air escape passage entrance is preferably below the molding temperature of the thermoplastic material, and more preferably at least about 20° F. below the molding temperature of the thermoplastic material. As used herein, the term "molding temperature" refers to the temperature of the thermoplastic at which the thermoplastic material has softened sufficiently to flow upon the application of the compressive force used during the molding process.

As those skilled in the art will appreciate from a full reading of the present specification, it is not necessary for the mold plate to be a temperature controlled mold plate during the entirety of the molding process. The preferred embodiments require only that the mold plate be a temperature controlled mold plate at the time the softened thermoplastic reaches the entrance to the air escape passage in the mold plate. As mentioned above, the air escape passage in preferred embodiments is located at about the furthest extent of the molding cavity, and, therefore, in such embodiments, it is only necessary that the mold plate be temperature controlled prior to the molding step being substantially complete.

It is contemplated that many steps and techniques may be used to produce a temperature controlled mold plate in accordance with the present invention, and all such steps and techniques are within the scope hereof. However, applicants have found that many additional benefits in overall performance can be realized by creating a temperature controlled mold plate according to the process described hereinafter in connection with FIG. 3.

As described generally above, it is preferred that the present methods comprise the step of softening the thermoplastic blank in at least about the region in which said projection is to be formed. It is contemplated that in most embodiments, the softening step will comprise heating the thermoplastic blank to its molding temperature. Many techniques for heating the blank to its molding temperature are adaptable for use within the broad aspects of the present invention. For example, it may be possible to heat the blank with direct exposure to hot gases or radiant heat sources.

In the preferred embodiments in which the blank is softened by contact with a heated mold plate, however, it is important that such softening step does not cause substantial flow of the thermoplastic material into the cavity of the mold plate unless and/or until the mold plate is temperature controlled as described herein. Preferably in such embodiments, the thermoplastic blank is softened by contact with a heated mold plate under conditions which are effective to rapidly transfer heat to the blank without causing substantial flow of the thermoplastic material into the cavity thereof. It is generally preferred that the softened thermoplastic has filled no greater than about 90% by volume, more preferably no greater than about 50% by volume, and even more preferably no greater than about 25% by volume of the mold during the softening step. The restriction on flow during the softening step is important in such embodiments because during a softening step in which the blank is heated by the mold plate, the mold plate will generally not be cooled in accordance herewith.

Figure 3:
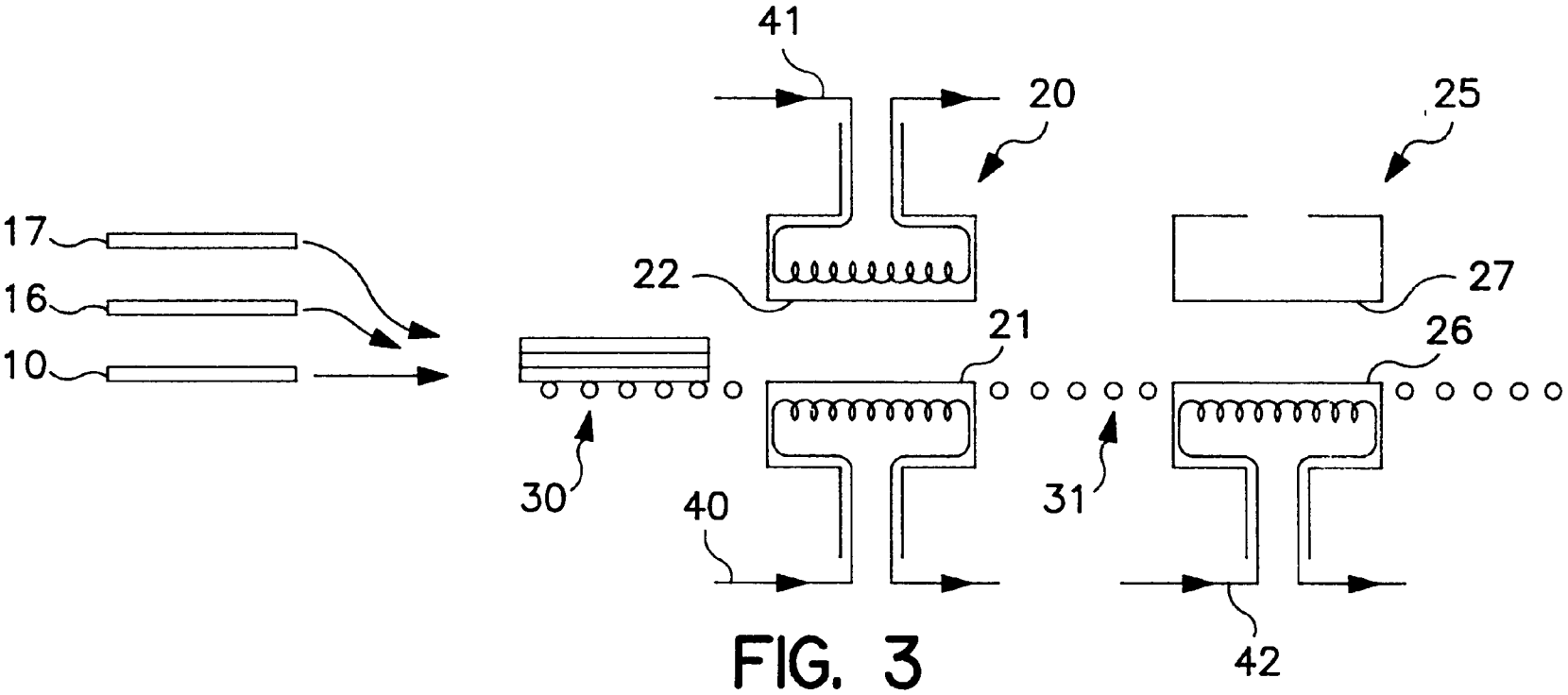
FIG. 3 is a schematic view of the equipment used to conduct the methods in accordance with one embodiment of the present invention.

Preferably, such a heating step occurs in a process as illustrated in FIG. 3 wherein a blank of thermoplastic 16 is brought into operative association with a mold plate 10 and transferred to a hydraulic press indicated generally at 20, preferably via a conveyor system 30. The press 20 has a first platen 21 and a second platen 22. The first platen 21 of press 20 is provided with a heating source (shown schematically as heating coil 40) so that the platen is heated to a predetermined temperature. In such embodiments, the heated plate 21 transfers heat to the underside of mold plate 10 which, in turn, transfers heat through and to the topside 11 of the plate, and from there to the thermoplastic blank 16.

The means for heating the first platen can be any of the well known means known in the art, such as by conduction with heated liquids, vapors or an electric heat source.

According to the preferred methods, it is desirable to maximize the rate of heat transfer from the first platen 21, through the mold 10, and to the blank 16. This will help to provide relatively short heating cycles and hence increased production rates. In order to ensure such desirably high rates of heat transfer, it is preferred to ensure intimate contact between the platen 21 and the mold plate 10 and between the mold plate 10 and the blank 16. Such intimate contact is preferably achieved by compressing the blank/mold combination between the first and second platens 21 and 22. The compressive force applied during such preferred heating step will vary depending upon the particular application. However, the compression is preferably not sufficient to cause substantial flow of the thermoplastic material into the cavity. According to preferred embodiments, the compressive force applied during the heating step is such that no more than about 90%, and even more preferably no more than about 75% of the thickness of the cavity contains softened thermoplastic at the conclusion of the heating step.

The desired temperature to which the first platen is heated will be preselected and will vary according to, among other things, the thermoplastic material to be heated, the thickness and heat conductivity of the first platen and the mold plate, the length of time in which the thermoplastic material is in contact with the heated mold plate and the compressive force utilized to ensure effective heat transfer. Similarly, the particular time period in which the heating step occurs will vary according to, among other things, these same factors.

According to preferred embodiments in which the thermoplastic article being produced is a fabric-faced article, such as a carpeted throw-in mat, a fabric facing 17 is generally and preferably provided as a separate element. It will be appreciated however, that the fabric facing, such as tufted pile carpet, can be joined to a thermoplastic backing in a separate process. In either case, however, it is preferred that the present process includes the step of controlling the temperature of the fabric facing as the thermoplastic material is heated. Controlling the fabric facing temperature in this fashion helps to minimize deleterious deformation and/or flattening of the fibers as the thermoplastic blank is being softened.

For embodiments of the type illustrated in FIG. 3 in which the heating step occurs in press 20, the upper platen 22 preferably includes temperature control means, such a passage or passages having temperature controlling fluid circulating therein, indicated schematically as 41 in FIG. 3. In such embodiments, the desired temperature to which the second platen 22 is controlled will be preselected and will vary according to, among other things, the fibers and the thickness and heat conductivity of the second platen. For carpeted throw-in mat embodiments in which: (1) the mold is an aluminum alloy mold having a thickness of about 0.25 inches; (2) the thermoplastic blank is a thermoplastic polyolefin having a softening point of from about 170° F. to about 425° F. and is about 0.050 inches thick; and (3) the carpet is a tufted or non-woven carpet, the lower platen 21 is heated to a temperature of from about 250° F. to about 500° F. and the upper platen 22 is controlled to a temperature of from about 40° F. to about 220° F. Furthermore, it is generally preferred in such embodiments that the press exerts sufficient compressive force to ensure intimate contact between the underside of the mold plate 10 and the platen 21 so that relatively high rates of heat transfer can be achieved. According to preferred embodiments, the compressive force exerted in press 21 is less than about 50 psi, and even more preferably from about 10 to about 40 psi.

As mentioned hereinbefore, an important aspect of the present invention is the step of compression molding the softened thermoplastic into the projection-forming cavities of the mold when the temperature of the mold in the region of the air escape passage opening, which is frequently at about the furthest extent of the cavity, is below the molding temperature of the thermoplastic material, more preferably at least about 20° F. below, and even more preferably at least about 50° F. below the molding temperature of the thermoplastic material. As used herein, the term "compression molding" refers to the flowing of a polymer, preferably a thermoplastic polymer, into a cavity under pressure while the polymer is in a relatively softened condition, that is, at or above its molding temperature. It is contemplated that for most embodiments the thermoplastic material will be a material that is solid under room temperature conditions and atmospheric pressures.

Accordingly, compression molding of the material will most preferably include applying pressure to the material, such as by press 25 shown in FIG. 3, once the material has been softened by, for example, heating. In preferred processes, the heated mold plate 10 with the softened thermoplastic blank 16 material thereon is transferred by suitable means, such as conveyor system 31, to press 25. In such embodiments, the thermoplastic material which leaves press 21 will be at its molding temperature, that is, the temperature at which the thermoplastic material has been softened sufficiently to flow into the cavities 13 of the mold 10 upon the application of the pre-selected time and pressure conditions selected for operation of press 25. Furthermore, since in such preferred embodiments the heat is transferred to the thermoplastic blank via the mold plate 10, the mold plate will also be at about the molding temperature of the thermoplastic material as it leaves press 21.

As mentioned above, applicants have discovered that significant and important advantages can be achieved by utilizing a process in which the temperature in the region of the entrance to the air escape passage is sufficiently less than the molding temperature to prevent any substantial flow of thermoplastic material into the air escape passages. According to preferred embodiments, this is achieved by utilizing a mold plate in which the temperature of the plate at about the location of the opening of the air escape passage 14 into the cavity 13 is about 50° F. below the molding temperature of the thermoplastic material. Applicants have found that one preferred technique for achieving this result is to provide press 25 with a lower platen 26 having a temperature control source 42 associated therewith. Although it is contemplated that the temperature control source can comprise any one of several well-known temperature control means, according to the preferred embodiments of the type illustrated in FIG. 3, the temperature control source is circulating water, which is in operative association with the lower platen 26. In this way, when the blank/mold plate combination is transferred to press 25, heat is withdrawn from the mold plate through the underside 12 thereof. Since the preferred mold plates include air channels or a matrix of indentations located on the underside thereof, such an arrangement is capable of relatively rapidly and efficiently creating a temperature controlled mold plate in accordance with the present invention.

Once the blank/mold plate combination is transferred to press 25, the second platen 27 is lowered onto the combination and exerts a compressive force thereon. Those skilled in the art will appreciate that the preferred temperature controlling arrangement described herein has the advantage of not inhibiting flow of the softened thermoplastic into the cavity of the mold plate. More particularly, the molding pressure in such embodiments at once initiates flow of the thermoplastic material into the cavity and also ensures efficient and rapid heat transfer from the underside of the mold plate to the lower platen 26. In this way, the mold plate begins conversion to a temperature controlled mold plate within the meaning of the present invention substantially immediately upon initiation of the molding process. Furthermore, since cooling of the mold plate occurs through the underside thereof, a temperature gradient is induced in the thickness of the mold plate. Such a temperature gradient, which is referred to hereinafter as a "negative temperature gradient," allows the top side 11 of the mold plate 10 to remain substantially at the molding temperature during the initiation of the molding step. Thus, the thermoplastic material is able to readily flow into the cavity of the mold plate without any substantial detrimental impact from the cooling which occurs through the underside of the mold plate. On the other hand, the existence of such a negative temperature gradient is highly beneficial from the standpoint of preventing a flow of the thermoplastic material into the air escape passage 14 in the underside 12 of the mold plate 10. That is, as the softened thermoplastic approaches the opening of the air escape passage channel, it will begin to encounter cooler and cooler temperatures, which in turn will tend to solidify the thermoplastic material as it approaches the air escape passage, thereby minimizing or eliminating flow of thermoplastic material into the air escape passage channel.

In such embodiments, the desired temperature to which the first platen 26 is cooled will be preselected and will vary according to, among other things, the thermoplastic material, the thickness and heat conductivity of the first platen and the mold plate, and the length of time in which the thermoplastic material is subject to the compressive force. Similarly, the particular time period in which the compression step occurs will vary according to, among other things, the particular thermoplastic material to be molded and cooled, and the thickness and heat conductivity of the first platen and the mold plate.

For embodiments in which: (1) the mold plate is an aluminum alloy mold plate having a thickness of 0.250 inches; (2) the thermoplastic blank is about 0.050 inches thick and is formed from a thermoplastic polyolef in having a softening point of about 170° F.; and (3) the fiber facing is a tufted or non-woven carpet, the lower platen is preferably temperature controlled in the range of from about 40° F. to about 120° F., and the carpet/blank/mold combination is exposed to a compressive force of from about 50 psi to about 180 psi. According to these preferred embodiments, it is contemplated that the duration of the molding step will be less than about 120 seconds, and even more preferably, from about 10 to about 50 seconds.

COMPARATIVE EXAMPLE

In accordance with the prior art, a carpeted throw-in mat is formed by the application of relatively high pressure under heated conditions followed by the application of less pressure under cooled conditions. The process begins with the provision of a preformed blank of thermoplastic polyolefin having a thickness of 0.050 inches with a hardness on the Shore A scale of about 70 and a tufted pile carpet facing provided as a separate element. The thermoplastic blank and tufted pile carpet facing, collectively referred to as the composite blank, are placed on an 0.25 inch thick aluminum alloy mold plate having a plurality of frusto-conical cavities arranged in substantially regularly spaced rows extending downward from the top surface thereof. The surface of the mold plate has been previously subjected to a hardening treatment to improve the durability thereof.

The cavities in the mold plate used in the process have air escape passages located therein at the furthest extent from the topside of the mold plate so that the region of the cavities in which the air escape passages are located is last exposed to the thermoplastic material during the molding step. The air escape passages comprise open channels formed in the surface of the underside of the mold plate and extend from each cavity to a peripheral edge of the mold plate.

The thermoplastic material portion of the composite blank is brought into operative association with the top surface of the mold plate and both the composite blank and the mold plate are transferred via a conveyor system to a hydraulic press having a lower platen and an upper platen. The lower platen of the first press is heated by means of a heating coil running therethrough to a temperature of 350° F. The upper platen of the first press further comprises passages having temperature controlling fluid circulating therethrough so that the upper platen is temperature controlled to 120° F.

The cavities in the mold plate used in the process have air vents located therein at the furthest extent from the topside of the mold plate so that the region of the cavities in which the air vents are located is last exposed to the thermoplastic material during the molding step. The air vents comprise open channels formed in the surface of the underside of the mold plate and extend from the each cavity to a peripheral edge of the mold plate.

A compressive force of about 80 psi is applied to the composite blank/mold plate combination for about 90 seconds causing the heated thermoplastic material to flow into and fill the projection-forming cavities of the mold. Because of the application of relatively high pressure under heated conditions, the thermoplastic material will continue to flow beyond the confines of the cavities themselves and into many of the air vent channels.

The heated mold plate and the composite blank now bearing a plurality of downwardly extending projections from the underside thereof is then transferred via a conveyor system to a second hydraulic press having an upper platen and a lower platen. The lower platen of the second press further comprises passages having temperature controlling fluid circulating therethrough so that the lower platen of the second press is temperature controlled to about 45° F.

Once the transfer to the second press is complete, the second press exerts a compressive force thereon of about 30 psi for about 90 seconds (a typical prior art time interval) in order to effect heat transfer.

Upon completion of the cooling step, unwanted extensions to the downwardly extending projections are encountered and the air vent channels are constructed with thermoplastic material which has flowed beyond the cavities of the mold plate.

EXAMPLE

In accordance with the present invention, a carpeted throw-in mat is formed. The process begins with the provision of the same preformed composite blank and mold plate used in the Comparative Example.

As in the Comparative Example, the thermoplastic material portion of the composite blank is brought into operative association with the top surface of the mold plate and both the composite blank and the mold plate are transferred via a conveyor system to a hydraulic press having a lower platen and an upper platen. The lower platen of the first press is heated by means of a heating coil running therethrough to a temperature of about 400° F. The upper platen of the first press further comprises passages having temperature controlling fluid circulating therethrough so that the upper platen is temperature controlled to about 180° F.

The methods of the present invention comprise the steps of applying a compressive force with the first press of about 20 psi to ensure intimate contact between the underside of the mold plate and the lower platen so that relatively high rates of heat transfer can be achieved but without substantial flow of the thermoplastic material into the cavities. During this step, the heated lower platen transfers heat to the underside of the mold plate which, in turn, transfers heat through and to the topside of the plate, and from there to the thermoplastic material of the composite blank. The thermoplastic material of the composite blank is thus heated to its molding temperature.

The heated mold plate and the composite blank is then transferred via a conveyor system to a second hydraulic press having an upper platen and a lower platen. The lower platen of the second press further comprises passages having temperature controlling fluid circulating therethrough so that the lower platen of the second press is temperature controlled to about 110° F., that is, about 60° F. below the molding temperature of the thermoplastic material.

Once the transfer to the second press is complete, the molding step takes place in which the second press exerts a compressive force of about 100 psi for 30 seconds in order to effect the compression molding of the heated thermoplastic material. Because the temperature of the mold plate in the region of the air vent entrances is about 50° F. below the molding temperature of the thermoplastic material at the time the softened thermoplastic reaches the entrance to the air vents in the mold, the softened thermoplastic material becomes progressively cooler as it flows into the cavities. Upon reaching the entrance to the air vents, the thermoplastic material has cooled to below its molding temperature and, consequently, does not flow into the air vent channels.

Upon completion of the compression molding step, a plurality of downwardly extending nibs are thus formed on the underside of the thermoplastic material in a shorter cycle time as compared to the methods of the prior art. In further contrast to the Comparative Example, the throw in mats made in accordance with the methods of the present invention avoid the undesired flow of thermoplastic material into the air vent channels and the resulting undesirable extensions to the nibs representing the hardened additional material which has flowed into the air vent channels. Also avoided is the blockage of the air vent channels by thermoplastic material which remains in the channel upon removal of the mat.

What is claimed is:

1. A method of making tufted pile floor mats having nibs formed thereon comprising the steps of:

a) placing a preformed sheet of thermoplastic material on a mold plate having a plurality of cavities therein for forming said nibs and air escape passages leading from cavities to an edge of said mold plate;

b) placing a preformed layer of tufted pile fabric on the thermoplastic sheet;

c) placing the mold plate in a first mold press having an upper platen maintained at a temperature of from about 40° F. to about 220° F. and a lower platen heated to a temperature of from about 250° F. to about 500° F;

d) applying from about 10 psi to about 50 psi of pressure to the mold plate, thermoplastic sheet and fabric by contacting said upper platen against said fabric for no longer than about 60 seconds to heat the thermoplastic sheet and thereby produce a heated mold plate and a heated thermoplastic sheet, said heated mold plate having less than about 90% by volume of said cavities containing said thermoplastic material;

e) transferring the heated mold plate bearing the heated thermoplastic sheet and the fabric to a second press having a lower platen maintained at a temperature of about 40° F. to about 120° F.; and f) applying about 50 psi to about 180 psi of pressure to the heated mold plate, heated thermoplastic sheet and the fabric by compression against said lower platen of the second press for no longer than about 30 seconds to substantially fill said plurality of cavities with heated thermoplastic material to produce a plurality of nibs.

2. A method of making thermoplastic articles having an integral projection extending from a surface thereof comprising:

a) providing a blank of said thermoplastic;

b) providing a mold plate having a top side, an underside, and at least one cavity for forming said integral projection;

c) providing an escape passage for allowing air to escape from said at least one cavity of said mold plate during the molding process;

d) heating said blank of thermoplastic material by contact with said mold plate; and e) causing a portion of said thermoplastic to flow into said at least one cavity while maintaining the temperature at about the entrance to said escape passage below the molding temperature of the thermoplastic material, thereby minimizing or eliminating flow of said thermoplastic material into said escape passage, to form the integral projection.

3. The method of claim 2 wherein said blank is a normally solid preformed blank of said thermoplastic.

4. The method of claim 2 wherein said heating step softens the thermoplastic in at least about the region in which said projection is to be formed and wherein said step of causing the thermoplastic to flow comprises pressing said softened thermoplastic into said at least one cavity.

5. The method of claim 4 wherein said heating step comprises heating said mold plate to a predefined temperature and transferring heat to said blank by contact with said heated mold plate under conditions sufficient to soften the thermoplastic without causing substantial flow thereof.

6. The method of claim 5 wherein said predefined temperature is from about 250° F. to about 500° F.

7. The method of claim 5 wherein the heating step is performed in a press having a first platen for heating the mold.

8. The method of claim 7 further comprising the steps of:

(i) providing a blank of fabric facing; and (ii) joining said fabric facing to said thermoplastic blank.

9. The method of claim 8 wherein the press has a second platen for controlling the temperature of said blank of fabric.

10. The method of claim 9 wherein said second platen of the press is temperature controlled to about 40° F. to about 220° F.

11. The method of claim 7 wherein the first platen of the press is heated to about 250° F. to about 500° F., and the duration of said heating step is from about 10 to about 120 seconds.

12. The method of claim 7 wherein the press exerts a compressive force of about 10 psi to about 50 psi.

13. The method of claim 8 wherein said fabric blank and said thermoplastic blank comprise a preformed composite blank.

14. The method of claim 2 wherein the temperature at about the entrance to said escape passage is at least about 20° F. below the molding temperature of the thermoplastic material.

15. A method of making floor mats of the type having a fabric layer joined to and overlying a base layer of thermoplastic material having a plurality of nibs extending downward therefrom arranged in a preselected pattern comprising the steps of:

a) placing a preformed sheet of the thermoplastic material on a mold plate having a plurality of cavities therein for forming said nibs and air vents leading from said cavities to an edge of said mold plate;

b) placing a preformed layer of the fabric on the thermoplastic sheet;

c) placing the mold plate in a first press having a first platen and a second platen wherein the first platen is at a temperature of about 250° F. to about 500° F. and the second platen is at a temperature of about 40° F. to about 220° F.;

d) applying about 10 psi to about 50 psi of pressure to the mold plate, thermoplastic sheet and fabric by contacting said second platen against said fabric for no longer than about 60 seconds to heat the thermoplastic sheet and thereby produce a heated mold plate and a heated thermoplastic sheet;

e) transferring the heated mold plate bearing the heated thermoplastic sheet and the fabric to a second press having a first platen and a second platen wherein the first platen is at a temperature of about 40° F. to about 120° F.;

f) applying about 50 psi to about 180 psi of pressure to the mold plate, thermoplastic sheet and fabric by contacting said second platen of the second press against said fabric for no longer than about 30 seconds, the combination of steps a) through f) thereby forming a plurality of nibs by the compression molding of the heated thermoplastic material into said the plurality of cavities in the mold plate; and g) removing the floor mat from the second press.

16. The method of claim 15 wherein said fabric layer and said thermoplastic blank comprise a preformed composite blank.

17. The method of claim 15 wherein said fabric layer comprises a woven fabric layer.

18. The method of claim 15 wherein said fabric layer comprises a non-woven fabric layer.

* * * * *